US010024203B2

(12) United States Patent
Hixenbaugh

(10) Patent No.: US 10,024,203 B2
(45) Date of Patent: Jul. 17, 2018

(54) WEDGE CLUTCH FOR A CAMSHAFT PHASER

(71) Applicant: Schaeffler Technologies AG & Co. KG, Herzogenaurach (DE)

(72) Inventor: Joshua Hixenbaugh, Wooster, OH (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 400 days.

(21) Appl. No.: 14/968,092

(22) Filed: Dec. 14, 2015

(65) Prior Publication Data

US 2017/0167313 A1 Jun. 15, 2017

(51) Int. Cl.
*F01L 1/34* (2006.01)
*F01L 1/344* (2006.01)

(52) U.S. Cl.
CPC ..... *F01L 1/3442* (2013.01); *F01L 1/344* (2013.01); *F01L 2001/34423* (2013.01); *F01L 2001/34459* (2013.01)

(58) Field of Classification Search
CPC ..... F01L 1/3442; F01L 2001/34459; F01L 1/344; F01L 2001/34423; F01L 2001/34463; F01L 2001/34479
USPC ..... 123/90.15, 90.17
See application file for complete search history.

(56) References Cited

U.S. PATENT DOCUMENTS 6,257,186 B1 * 7/2001 Heer ..... F01L 1/024 123/90.17
8,950,371 B2 * 2/2015 Schaefer ..... F01L 1/344 123/90.15
2009/0159390 A1 6/2009 Davis

OTHER PUBLICATIONS

U.S. Appl. No. 14/795,621, filed Jul. 9, 2015.
U.S. Appl. No. 14/700,968, filed Apr. 30, 2015.

* cited by examiner

*Primary Examiner* — Phutthiwat Wongwian
*Assistant Examiner* — Kelsey Stanek
(74) *Attorney, Agent, or Firm* — Volpe and Koenig, P.C.

(57) ABSTRACT

A wedge clutch for a camshaft phaser is disclosed. The wedge clutch includes a stator including a pressure plate. The wedge clutch further includes a wedge plate including a notch. The notch includes a pulling surface. The wedge clutch further includes a rotor including a pin inside of a chamber. The pin is configured to rotate the wedge plate in a first circumferential direction relative to the rotor by sliding along the pulling surface as the pin extends out of the chamber to disengage the wedge clutch from the pressure plate.

15 Claims, 3 Drawing Sheets

WEDGE CLUTCH FOR A CAMSHAFT PHASER

FIELD OF INVENTION

The present invention relates to a camshaft phaser, and, more particularly, to a wedge clutch for a camshaft phaser.

BACKGROUND

A clutch is a mechanism that controls rotational motion. Clutches are often found in engines and transmissions as a means to control relative rotation of a rotor and a stator. For example, U.S. Patent Application Publication No. 2009/0159390 to Davis discloses a friction one-way clutch for a transmission. The clutch includes a wedge ring that selectively engages a stator to prevent the stator from rotating in one direction.

Wedge clutches are also used in conjunction with cam phasers for engines. For example, a cam phaser may advance or retard the position of a camshaft relative to the crankshaft of the engine based on the positioning of one or more wedge clutches in order to improve efficiency.

However, it is difficult to control the positioning of a wedge clutch. Hydraulic pressure is often used for this purpose, but is not efficiently utilized in current designs. The present disclosure is directed to overcoming this and other problems of the prior art.

SUMMARY

In one aspect, a wedge clutch is provided. The wedge clutch includes a stator including a pressure plate. The wedge clutch further includes a wedge plate including a notch. The notch includes a pulling surface. The wedge clutch further includes a rotor positioned radially between the pressure plate and the rotor and including a pin inside of a chamber. The pin is configured to rotate the wedge plate in a first circumferential direction relative to the rotor by sliding along the pulling surface as the pin extends out of the chamber to disengage the wedge plate from the pressure plate.

In another aspect, a camshaft phaser is provided. The camshaft phaser includes a stator configured to receive torque from a crankshaft and a rotor configured to be non-rotatably connected to a camshaft. The rotor includes a plurality of first ramps and a pin inside of a chamber. The camshaft phaser further includes a first wedge plate. The first wedge plate includes a plurality of second ramps engaging the plurality of first ramps, and a notch including a pulling surface. The camshaft phaser further includes a pressure plate configured to engage the first wedge plate. The pin is configured to disengage the first wedge plate from the pressure plate by sliding along the pulling surface as the pin extends out of the chamber.

BRIEF DESCRIPTION OF THE DRAWING(S)

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
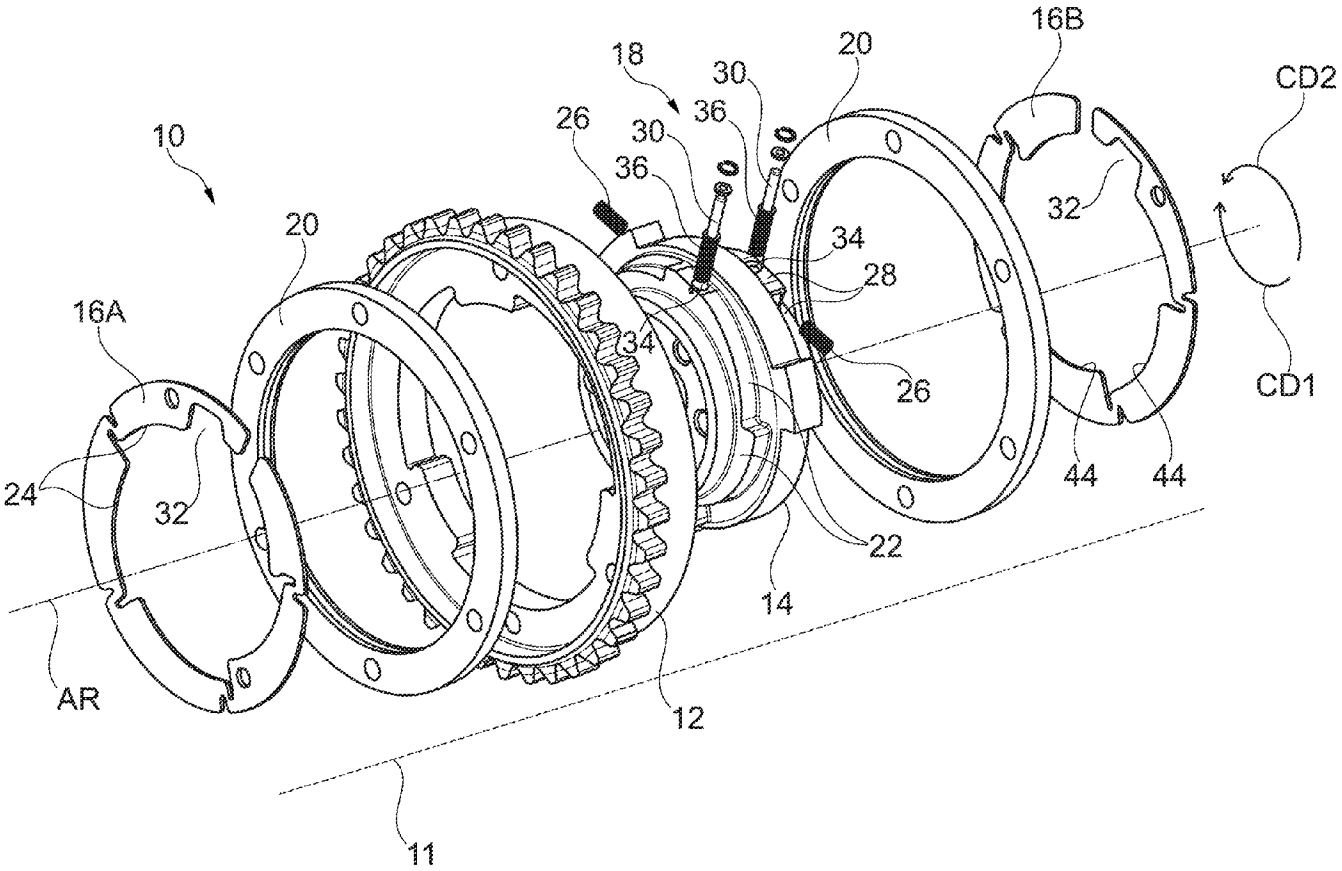
FIG. 1 shows a perspective exploded view of a camshaft phaser.

FIG. 1 shows an exemplary camshaft phaser 10. The camshaft phaser 10 includes an axis of rotation AR, and a wedge clutch 11. The wedge clutch 11 includes a rotatable stator 12 configured with teeth on a circumferential surface to receive torque from the crankshaft of an internal combustion engine (e.g., via a timing belt, chain, or gear), a rotatable rotor 14 configured to be non-rotatably connected to a camshaft, a first wedge plate 16A and a second wedge plate 16B radially disposed between the rotor 14 and the stator 12, and a displacement assembly 18. The first and second wedge plates 16A, 16B have ramps 24, 44, respectively, that are oriented in opposite circumferential directions. While the camshaft phaser 10 is depicted and described as including two one-way wedge clutches, it should be understood that the present disclosure encompasses embodiments that include one or more wedge clutches (e.g., one or more wedge plates).

The stator 12 includes a pair of pressure plates 20 configured to receive a pressure force from the wedge plates 16A, 16B to prevent rotation of the rotor 14 relative to the stator 12. In some embodiments, the pressure plates 20 may be integrally formed with the stator 12. The rotor 14 is positioned in the stator 12. The rotor 14 is configured to rotate relative to the stator 12 in both directions when the first wedge plate 16A and/or the second wedge plate 16B is disengaged from the corresponding pressure plate 20.

The relative positioning of the rotor 14 and the stator 12 determines a phase between the rotational input at the stator 12 and the rotational output at the rotor 14 (e.g., between a timing belt, chain, or gear and a camshaft). The rotor 14 may be "advanced" through rotation in a first circumferential direction CD1 relative to the stator 12. The rotor 14 may be "retarded" through rotation in a second circumferential direction CD2, opposite from the first circumferential direction, relative to the stator 12. The displacement assembly 18 is configured to control the position of the rotor 14 relative to the stator 12 via the wedge plates 16A and 16B.

Figure 2:
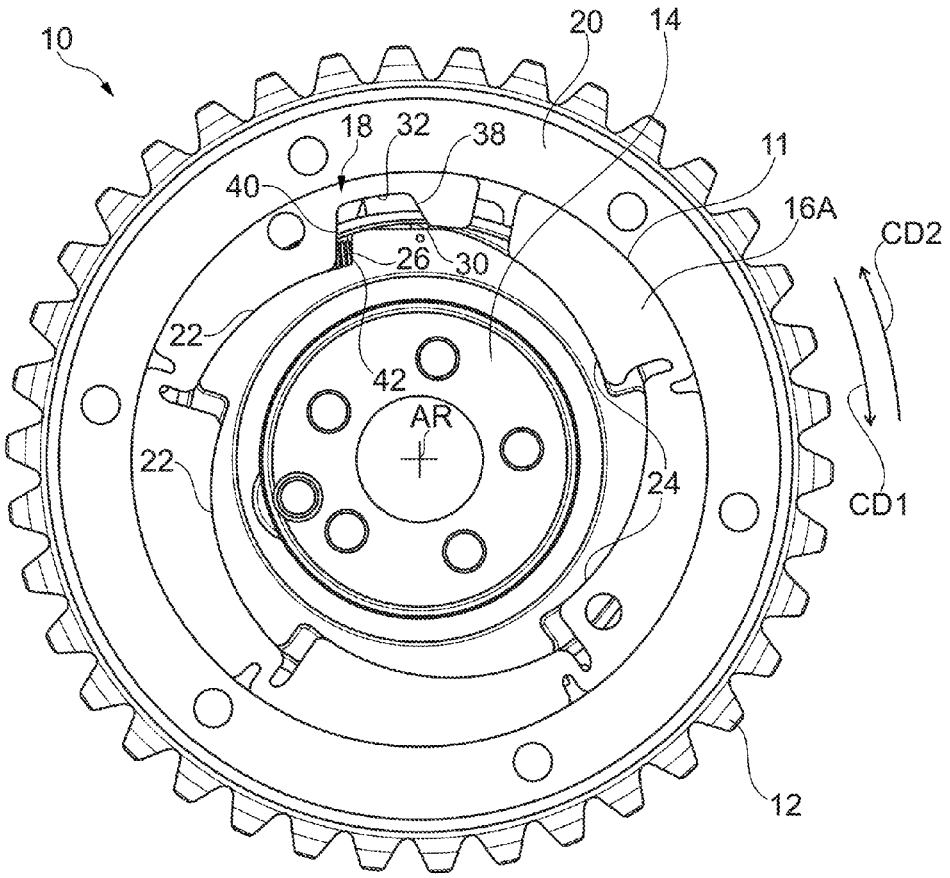
FIG. 2 shows a front view of the camshaft phaser of FIG. 1.

FIG. 2 shows one side of the assembled camshaft phaser 10. In particular, the side of the camshaft phaser 10 that includes the first wedge plate 16A is shown. The first wedge plate 16A is configured to advance the rotor 14. For example, displacement assembly 18 is configured to displace the first wedge plate 16A in the first circumferential direction CD1 to enable rotation of the rotor 14, with respect to the stator 12, in the first circumferential direction CD1.

The opposite side of the camshaft phaser 10 includes the second wedge plate 16B and functions in substantially the same manner as the first wedge plate 16A to selectively retard the rotor 14. For example, the displacement assembly 18 is configured to displace the second wedge plate 16B in the second circumferential direction CD2, to enable rotation of the rotor 14, with respect to the stator 12, in the second circumferential direction CD2.

The rotor 14 includes, on the side shown in FIG. 2, a first plurality of ramps 22 that define an engagement surface for the ramps 24 of the first wedge plate 16A. A radial location of the engagement surface of the ramps 22 decreases in the first circumferential direction CD1 and increases in the second circumferential direction CD2. That is, the first plurality of ramps 22 slope radially inward in the first circumferential direction CD1 and radially outward in the second circumferential direction CD2. The rotor 14 further includes, on the opposite side not shown in FIG. 2, a second plurality of ramps 28 that slope in an opposite direction (e.g., radially outward in the first circumferential direction CD1).

The ramps 24 on the first wedge plate 16A define a corresponding engagement surface for contacting the engagement surface of the first plurality of ramps 22. A radial distance of the ramps 24 decreases in the first circumferential direction CD1 and increases in the second circumferential direction CD2. That is, the ramps 24 slope radially inward in the first circumferential direction CD1 and radially outward in the second circumferential direction CD2. The ramps 44 on the second wedge plate 16B slope in an opposite direction of the ramps 24 (e.g., radially outward in the first circumferential direction CD1).

In an exemplary embodiment, the displacement assembly 18 includes a resilient element 26, such as a spring, on each side of the rotor 14. The first resilient element 26 is circumferentially disposed between the rotor 14 and the wedge plate 16A and is arranged to displace the first wedge plate 16A in the second circumferential direction CD2 with respect to the rotor 14 to lock the first wedge plate 16A through engagement with the corresponding pressure plate 20. The force of the resilient element 26 causes the ramps 24 to slide along the first plurality of ramps 22 on the rotor 14 to cause the first wedge plate 16A to lock against the pressure plate 20, and also eliminates back lash. In this way, the resilient element 26 forces the wedge plate 16A to maintain a non-rotatable position with respect to the corresponding pressure plate 20. The second resilient element 26 similarly forces the wedge plate 16B to maintain a non-rotatable position with respect to the other corresponding pressure plate 20.

In order to control a position of the rotor 14 with respect to the stator 12, the first wedge plate 16A and/or the second wedge plate 16B may be displaced relative to the rotor 14. For example, the first wedge plate 16A may be rotated in the first circumferential direction CD1 to slide the ramps 24 of the first wedge plate 16A down the first plurality of ramps 22 of the rotor 14, thereby moving the first wedge plate 16A inward toward the center of the rotor 14. This movement causes the first wedge plate 16A to disengage from the corresponding pressure plate 20, thereby allowing the rotor 14 to rotate relative to the stator 12 in the first circumferential direction CD1. Displacement of the second wedge plate 16B in the second circumferential direction CD2 may similarly disengage the second wedge plate 16B from the other corresponding pressure plate 20, thereby allowing the rotor 14 to rotate relative to the stator 12 in the second circumferential direction CD2.

The first and second wedge plates 16A and 16B are therefore configured to selectively allow the rotor 14 to rotate relative to the stator 12 in either the first circumferential direction CD1 or the second circumferential direction CD2, depending on which of the first and second wedge plates 16A and 16B are engaged with the corresponding pressure plates 20. The rotor 14, the first and second wedge plates 16A and 16B, and the displacement assembly 18 are configured to control the locking and unlocking of the wedge plates 16A and 16B.

The displacement assembly 18 includes a pin 30. The pin 30 is positioned in a chamber 34 in the rotor 14. In one embodiment, the pin 30 is biased into the chamber 34 by a spring 36, although other configurations are possible.

A notch 32 is formed in the first wedge plate 16A. In an exemplary embodiment, the notch 32 is positioned adjacent to a free end of the first wedge plate 16A. The notch 32 includes a pulling surface 38. The pulling surface 38 is angled or curved toward an inside of the notch 32 as the pulling surface 38 extends radially outward. The wedge plate 16A is positioned relative to the rotor 14 such that the pulling surface 38 is positioned at a top portion of a first ramp 22A of the first plurality of ramps 22 of the rotor 14.

The notch 32 is further formed by an engagement surface 40 positioned opposite from the pulling surface 38. The engagement surface 40 is longer than the pulling surface 38 such that the engagement surface 40 is configured to extend to a position near the bottom of a second ramp 22B of the first plurality of ramps 22 of the rotor 14. The first ramp 22A may be directly adjacent to the ramp 22B and the resilient element 26 may be positioned in a wall 42 between the adjacent ramps 22A and 22B such that the resilient element 26 contacts the engagement surface 40. It should be understood, however, that other arrangements are possible.

Figure 3:
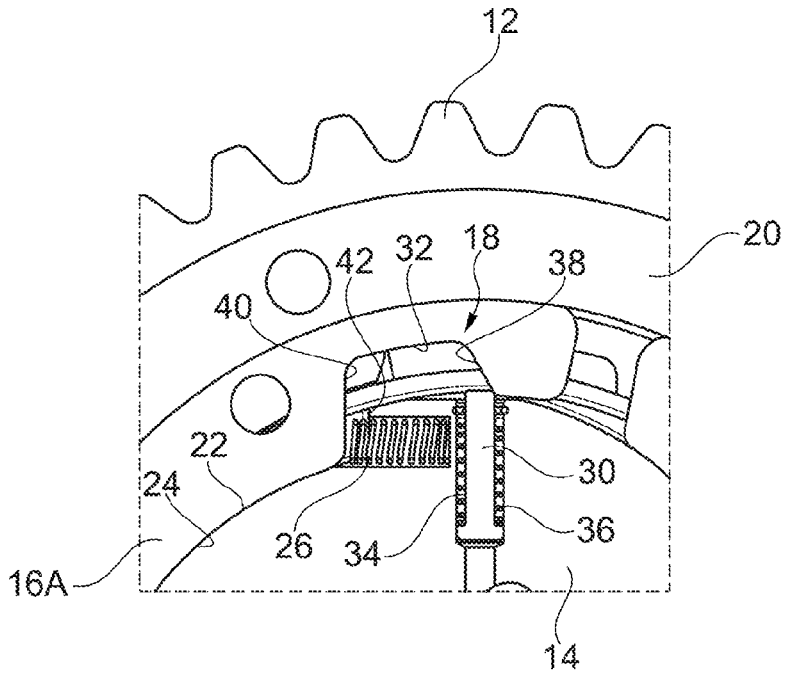
FIG. 3 shows the camshaft phaser of FIG. 1 in a locked position.
Figure 4:
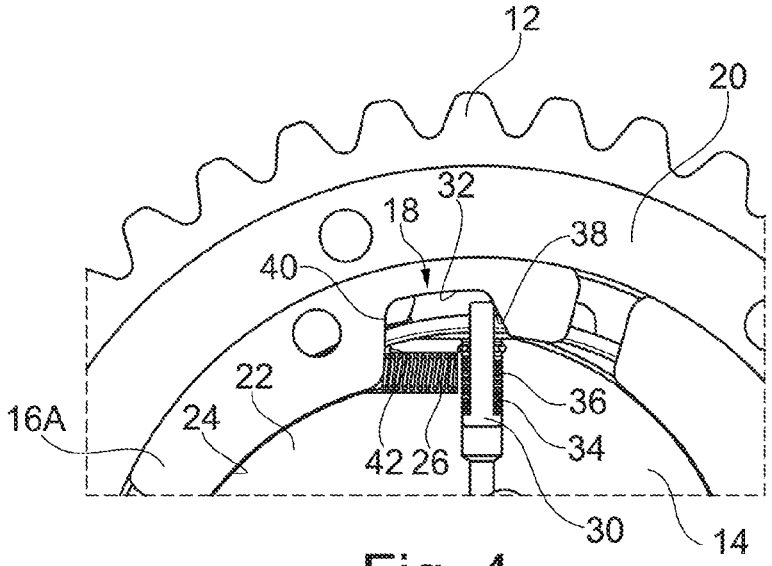
FIG. 4 shows the camshaft phaser of FIG. 1 in an unlocked position.

FIG. 3 shows the first wedge plate 16A in a locked position. As shown, the pin 30 extends only slightly out of the chamber 34. In this position, a top of the pin 30 is positioned near a bottom of the pulling surface 38. In order to displace the first wedge plate 16A in the first circumferential direction CD1 and unlock the first wedge plate 16A, the pin 30 is forced out of the chamber 32, such as to the position of FIG. 4.

The pin 30 may be preferably configured to extend out of the chamber 32 via hydraulic pressure. For example, a control valve may selectively direct hydraulic fluid into the chamber 32, to a base of the pin 30. The hydraulic fluid acts against the force of the spring 36 to push the pin 30 out of the chamber 32. The control valve may also selectively direct the hydraulic fluid away from the pin 30 to remove the pressure and allow the force of the spring 36 to pull the pin 30 back into the chamber 32.

As the pin 30 extends out of the chamber 32, the top of the pin 30 slides along the pulling surface 28, thereby forcing the first wedge plate 16A to rotate in the first circumferential direction CD1, against the force of the resilient element 26. Therefore, the pin 30 is configured to disengage the wedge plate 16A from the pressure plate 20 by sliding along the pulling surface 38 as the pin 30 extends out of the chamber 32. In this way, the pin 30 may be selectively controlled to unlock the first wedge plate 16A from the corresponding pressure plate 20, thereby allowing the rotor 14 to rotate in the first circumferential direction CD1 relative to the stator 12. The pin 30 may be controlled in any manner known in the art, such as via a hydraulic pressure control valve, as described above.

It should be understood that a similar mechanism for locking and unlocking the second wedge plate 16B is provided on the other side of the rotor 14. For example, a similar arrangement of a resilient element 26, pin 30, and notch 32 may be included and function in substantially the same manner in order to selectively disengage the wedge plate 16B to allow the rotor 14 to rotate in the second circumferential direction CD2 with respect to the stator 12.

The disclosed wedge clutch 11 provides a mechanism for efficiently controlling the positioning of the wedge plates 16A and 16B. The configuration of the notch 32 allows the wedge plates 16A, 16B to be pulled from near a free end of the wedge plates 16A, 16B around the rotor 14, which allows for a consistent application of force. Further, the positioning of the notch 32 on each of the respective first and second wedge plates 16A, 16B allows the pulling force to be applied near the force applied by resilient element 26. This allows the pulling force to overcome the force of the resilient element 26 more easily. These advantages help to produce a reliable camshaft phaser.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A wedge clutch, comprising:

a stator including a pressure plate;

a wedge plate including a notch, the notch comprising a pulling surface; and a rotor including a pin inside of a chamber, wherein the wedge plate is located radially between the stator and the rotor, and wherein the pin is configured to rotate the wedge plate in a first circumferential direction relative to the rotor by sliding along the pulling surface as the pin extends out of the chamber to disengage the wedge plate from the pressure plate.

2. The wedge clutch of claim 1, wherein the pulling surface is angled or curved toward an inside of the notch as the pulling surface extends radially outward.

3. The wedge clutch of claim 1, wherein the notch is positioned adjacent to a free end of the wedge plate.

4. The wedge clutch of claim 1, wherein the notch further includes an engagement surface positioned opposite from the pulling surface.

5. The wedge clutch of claim 4, wherein the engagement surface is longer than the pulling surface.

6. The wedge clutch of claim 4, wherein the rotor includes a resilient element configured to apply a force on the engagement surface to bias the wedge plate in a second circumferential direction, opposite from the first circumferential direction to engage the wedge plate with the pressure plate.

7. The wedge clutch of claim 1, wherein the pin is configured to extend out of the chamber via hydraulic pressure.

8. A camshaft phaser, comprising:

a stator configured to receive torque from a crankshaft and including a pressure plate;

a rotor configured to be non-rotatably connected to a camshaft and including a plurality of first ramps and a pin inside of a chamber; and a first wedge plate including a plurality of second ramps engaging the plurality of first ramps and a notch including a pulling surface, wherein the pressure plate is configured to engage the wedge plate, wherein the pin is configured to disengage the wedge plate from the pressure plate by sliding along the pulling surface as the pin extends out of the chamber.

9. The camshaft phaser of claim 8, wherein the second plurality of ramps are configured to slide down the first plurality of ramps to move the first wedge plate inward toward the center of the rotor, the inward movement disengaging the first wedge plate from the pressure plate.

10. The camshaft phaser of claim 8, wherein the rotor further includes a resilient element configured to bias the first wedge plate toward a position in which the wedge plate engages the pressure plate.

11. The camshaft phaser of claim 10, wherein the notch further includes an engagement surface positioned opposite from the pulling surface, the resilient element configured to apply a force on the engagement surface to bias the first wedge plate to engage the pressure plate.

12. The camshaft phaser of claim 11, wherein the engagement surface is longer than the pulling surface.

13. The camshaft phaser of claim 11, wherein the pin is positioned near a top portion of a first ramp of the plurality of first ramps and the resilient element is positioned near a bottom portion of a second ramp of the plurality of second ramps.

14. The camshaft phaser of claim 13, wherein the first ramp is directly adjacent to the second ramp.

15. The camshaft phaser of claim 8, wherein the first wedge plate is positioned on a first side of the rotor and the camshaft phaser further includes a second wedge plate positioned on a second side of the rotor.

* * * * *